US007500286B2

(12) United States Patent
Soviknes

(10) Patent No.: US 7,500,286 B2
(45) Date of Patent: Mar. 10, 2009

(54) HINGE

(76) Inventor: Ole Gunnar Soviknes, Saksarlia 173, 5253 Sandsli (NO)

( * ) Notice: Subject to any disclaimer, the term of this patent is extended or adjusted under 35 U.S.C. 154(b) by 102 days.

(21) Appl. No.: 10/548,263

(22) PCT Filed: Jan. 29, 2004

(86) PCT No.: PCT/NO2004/000027

§ 371 (c)(1),
(2), (4) Date: Sep. 6, 2005

(87) PCT Pub. No.: WO2004/081326

PCT Pub. Date: Sep. 23, 2004

(65) Prior Publication Data

US 2006/0075601 A1 Apr. 13, 2006

(30) Foreign Application Priority Data

Mar. 10, 2003 (NO) ..... 20031083

(51) Int. Cl.
*E05D 7/04* (2006.01)

(52) U.S. Cl. ..... 16/243; 16/245; 16/248; 16/386

(58) Field of Classification Search ..... 16/243, 16/244, 245, 240, 248, 387, 386, 381
See application file for complete search history.

(56) References Cited

U.S. PATENT DOCUMENTS

| | | | | | |
|---|---|---|---|---|---|
| 2,179,931 | A | * | 11/1939 | Harris | 16/274 |
| 2,588,258 | A | * | 3/1952 | Lowman | 16/243 |
| 3,592,257 | A | * | 7/1971 | Matyas | 160/186 |
| 3,787,923 | A | * | 1/1974 | Peterson | 16/308 |
| 4,381,580 | A | * | 5/1983 | Hellstrom et al. | 16/243 |
| 4,937,916 | A | * | 7/1990 | Redman | 16/243 |
| 5,689,855 | A | * | 11/1997 | Tang | 16/235 |
| 6,397,432 | B1 | * | 6/2002 | di Vinadio | 16/242 |
| 6,434,791 | B1 | * | 8/2002 | Chung | 16/387 |
| 6,484,363 | B1 | * | 11/2002 | Chung | 16/242 |
| 6,757,938 | B1 | * | 7/2004 | di Vinadio | 16/242 |

FOREIGN PATENT DOCUMENTS

| | | | | |
|---|---|---|---|---|
| DE | 2740415 | A | * | 3/1979 |
| EP | 387207 | A1 | * | 9/1990 |
| EP | 791713 | A1 | * | 8/1997 |
| EP | 930411 | A1 | * | 7/1999 |
| EP | 992647 | A2 | * | 4/2000 |
| GB | 2119434 | A | * | 11/1983 |
| JP | 08284518 | A | * | 10/1996 |

* cited by examiner

*Primary Examiner*—Chuck Y. Mah
(74) *Attorney, Agent, or Firm*—Dennison, Schultz & MacDonald

(57) ABSTRACT

A hinge, particularly for doors, having a support element (11, 12) for a hinge-pin (13), the support element having a hinge-plate (11) for installation in a door casing, and a lower sleeve (12) which is designed to support a hinge-pin (13). The hinge-pin (13) supports an upper sleeve (14), which is connected to an upper hinge-plate (15), for connection with the door leaf. On the hinge-pin (13) is arranged at lest one sleeve (23), particularly of a plastic material. The sleeve (23) has an axial hole (25), for a part (19) of the hinge-pin (13), where the hole (25) is eccentrically located in relation to the axis of the sleeve and to its outer surface, as the sleeve (23) is arranged to be pivotable in the accommodating sleeve (12).

4 Claims, 1 Drawing Sheet

HINGE

This application is a filing under 35 USC 371 of PCT/NO2004/000027 filed Jan. 29, 2004.

The present invention relates to a hinge, especially for use on doors.

BACKGROUND OF THE INVENTION

In the hinging of doors for offices, housing, and various institutions, a hinge is normally provided, having a pin supported casing, and on this casing a detachable, attached sleeve is supported on the door leaf. Hinges like this have two disadvantages: firstly, the door leaf sags, either because of wear and tear, or because the parts are displaced, for example, due to of overstrain, and secondly, the door leaf is inclined to the extent that it is touching the casing at the underside.

Norwegian Patent application 20010820 discloses a door hinge having a support element for a hinge-pin, where the support element has a lower hinge-plate for mounting in a door casing, and a sleeve which is designed for support on the hinge-pin. The sleeve is connected to an upper hinge-plate for connection to a door leaf. On the hinge-pin is a sleeve, particularly of a plastic material, having a bushing with annular flanges at the free ends, which is capable of pivoting in relation to the sleeve. The bushing is duplex, comprising two bushing parts, where the annular flange creates an axial gliding surface against the opposite surfaces on the sleeve. The sleeve has a recess in at least one end, for receiving the annular flange on the adjacent part of the bushing.

This solution has no opportunity for elevation of the door leaf, which has sagged so much that it touches the door casing at the underside, and no opportunities for adjustment of the obliquity, where the door leaf clamps in the door casing, both sidewise and/or at the lower edge.

SUMMARY OF THE INVENTION

The main object of the invention is to improve the known hinge in such a way that the disadvantages described above are eliminated. Also, simplification is desirable such that there are as few parts as possible, to provide the easiest possible way to install the hinge.

Further, it is an object of the invention to manufacture the hinge as inexpensively as possible, and ensuring it is as easy as possible to maintain and adjust so that no special training or knowledge is required.

The hinge should also be lubrication free.

DETAILED DESCRIPTION OF THE INVENTION

The invention is described in claim 1, and particularly advantageous features are described by the following claims 2-6.

Firstly, this hinge provides an opportunity for the adjustment of any oblique inclination that may cause sidewise obstruction. This makes it easy to install the hinge and door satisfactorily.

Furthermore, the hinge provides adjustment of the height of the door leaf, in such a way that restriction to movement is avoided at the underside. Both forms of adjustment may be done without any special training or instructions. This makes the novel hinge very user-friendly.

The invention may primarily be used for door leaves that are supported by two hinges, i.e. interior doors for housing, offices, hotels and institutions where it is sufficient to have two hinges per door leaf.

BRIEF DESCRTION OF THE DRAWINGS

The invention is described in more detail below and with reference to the drawings, wherein.

DESCRIPTION OF THE PREFERRED EMBODIMENTS

Figure 1:
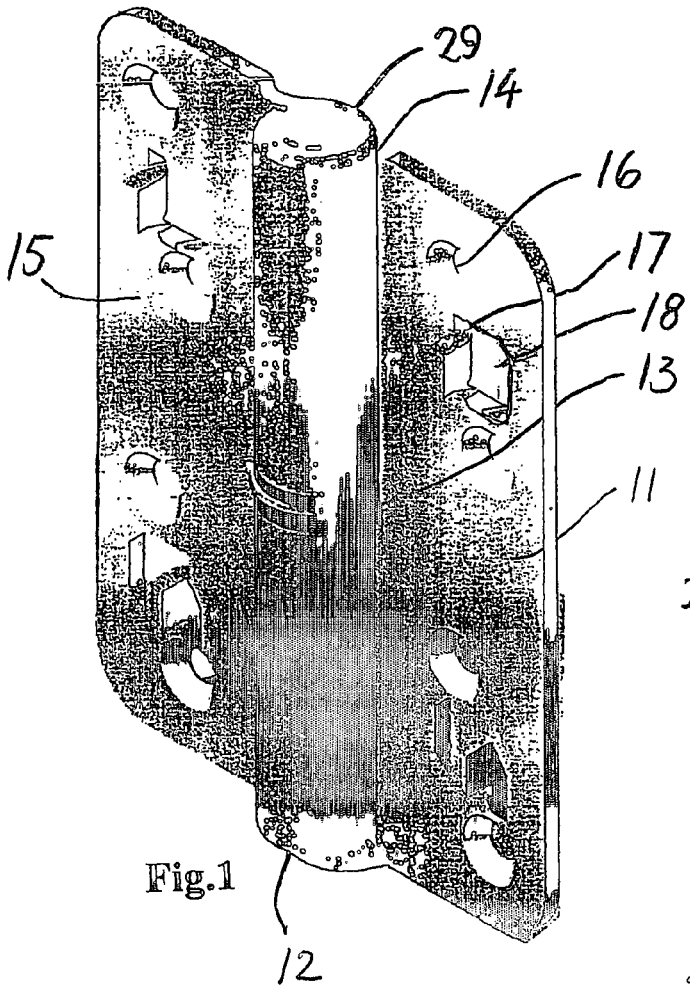
FIG. 1 shows a perspective view of a hinge according to the invention.

In FIG. 1, shown is a hinge according to the invention. It comprises a casing hinge-plate 11, designed for mounting to a door casing (not shown), a lower sleeve 12 integrated with casing hinge-plate 11 to support hinge-pin 13 as shown further in FIG. 2. The hinge further comprises an upper sleeve 14, which is integrated with door hinge-plate 15, designed for being mounted to a door leaf (not shown) to keep it pivotable. The hinge-plates 11 and 15 are provided with four countersunked holes 16 for screws, and pressed tongues 17 which can mate with corresponding recesses 18 in the reciprocal hinge-plate to lock the hinge. The hinge-plates and the corresponding sleeves are manufactured of steel, having a practical surface finishing. For the mounting of a door leaf, preferably two hinges, according to the invention, are used.

Figure 2:
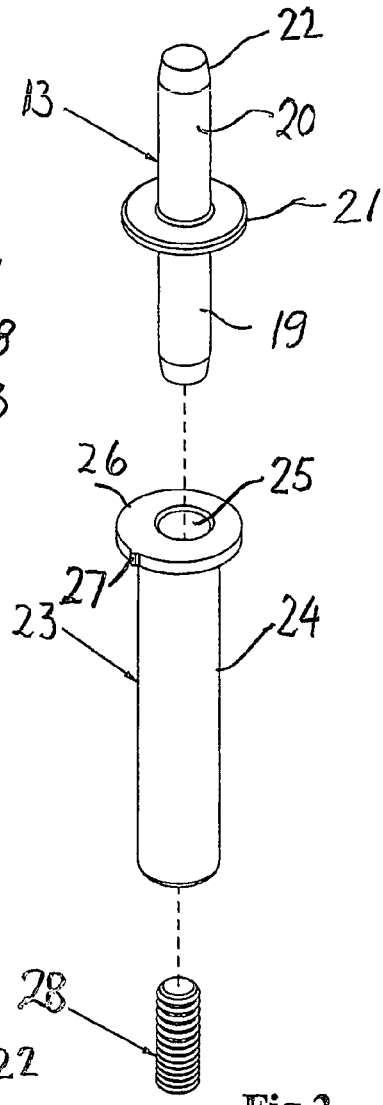
FIG. 2 shows an exploded perspective view of the hinge-pin with the underlying sleeve and the corresponding adjustment screw.
Figure 4:
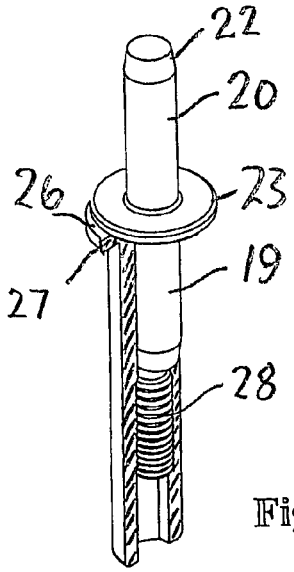
FIG. 4 shows a partial sectioned perspective view of the sleeve in FIG. 3, with the hinge-pin and the adjustment screw mounted.

In FIG. 2, a hinge-pin 13, having a lower cylindrical part 19, an upper cylindrical part 20, and in between, a flange 21, designed in steel is shown. The free ends of the two cylindrical parts 19 and 20, have a chamfered edge 22. Further, a lower sleeve 23 in plastic material, having a cylindrical main part 24, with an eccentric hole 25 for the hinge-pin 13, and an end flange 26 having a lug 27 standing out, is shown. At the edge of the sleeve, up to the lug 27, there can be applied markings (not shown) thereby creating a scale for the actual range of pivoting. The eccentricity (the axial displacement) may be in the range of 0.5-2 mm. FIG. 2 shows a hexagonal screw 28 designed for insertion in sleeve 23 from below, as shown in FIG. 4 and described below. In the upper sleeve 14, in the door hinge-plate 15, there is inserted a corresponding sleeve 29, (FIG. 1), having concentric or eccentric holes for the upper part 20 of the shaft extrusion 13.

Figure 3:
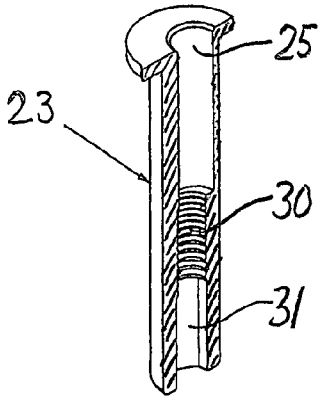
FIG. 3 shows a section through the perspective view of the lower sleeve.

FIG. 3 shows a section through the lower sleeve 23. The eccentric located hole 25 for the lower part 19 of the hinge-pin 13, extends down to a thread area 30, which, from below, is insertion of the hexagonal screw 28, having meshing grooves facing downwards. This is accessible from below, through a lower part 31 of the opening, which has a hexagonal profile for meshing of a wrench or other pivoting tool. The sleeve 23 is of dimension, which results in a tight sliding fit against the lower sleeve 12.

In FIG. 4, the lower sleeve 23 is shown with the shaft extrusion 13 and the hexagonal screw 28 assembled. The flange 21 of the hinge-pin 13 may bear against the flange 26, but for adjustment of the hexagonal screw 28, this can support the hinge-pin and hold this, in such a way that a gap is created between the two flanges 21 and 26.

The position of the door leaf may be adjusted in elevation by turning the hexagonal screw 28. In this way an ensuing sag can be eliminated, so that pinching is avoided at the lower edges of the door leaf.

The position of the door leaf may, in the aforementioned example of an embodiment, be adjusted sidewise by means of the lower sleeve 23. By pivoting the sleeve 23, the eccentric location of the inner hole 25 for the hinge-pin will provide displacement of the turning axis of the door. In addition, to prevent pinching, this will ensure neutral location of the door leaf.

At least one sleeve for each door has been designed with eccentric location of the inner hole 25. The hole can be located in both the lower and upper part of the hinge, and can be arranged in the lower or upper hinge or in both. This means that the sleeve, having eccentric holes, can be located independent of the screw, for adjustment of the height of the hinge-pin, even though this is a less favourable solution.

Materials, other than the ones used in the example above, can also be used.

The invention claimed is:

1. A hinge for doors comprising:

a lower hinge plate constructed and arranged for attachment to a door casing through exposed screw holes, the lower hinge plate having integrated therewith a lower support sleeve;

an upper hinge plate constructed and arranged for attachment to a door through exposed screw holes, the upper hinge plate having integrated therewith an upper sleeve, the lower hinge plate and the upper hinge plate being substantially identical and interchangeable;

the lower support sleeve and the upper sleeve each including a bushing disposed and fitting closely therein, each said bushing being cylindrical between first and second ends and having an axial hole therein for placement of a hinge pin; and a hinge pin extending between the bushing of the lower support sleeve and the bushing of the upper sleeve and passing through the axial holes of the bushings, the hinge pin being supported by the lower support sleeve, and carrying the upper sleeve, wherein the axial hole of at least one of the bushings is eccentric to the axis of the bushing, and the at least one bushing with the eccentric axial hole comprises a radial flange at the first end thereof, accessible between the upper sleeve and the lower support sleeve, from outside the hinge to enable rotation of the bushing, and wherein the bushing of the lower support sleeve is internally threaded below the axial hole, and carries an externally threaded screw therein, which can be rotated to lift the hinge pin.

2. A hinge according to claim 1, wherein the eccentricity to the axis is about 0.5-2 mm.

3. A hinge according to claim 1, wherein the lower bushing includes the flange, and the hinge pin includes a flange which rests on the flange of the lower bushing.

4. A hinge according to claim 1, wherein the at least one flange having the eccentric hole comprises an indicator lug.

* * * * *